US006806423B1

(12) United States Patent
Harris et al.

(10) Patent No.: US 6,806,423 B1
(45) Date of Patent: Oct. 19, 2004

(54) GROUNDING DEVICE FOR HIGH SPEED WATER VEHICLES

(75) Inventors: John Harris, Merrimack, NH (US); David George Klingensmith, Sr., Virginia Beach, VA (US); Marvin Bradford Hardy, Jr., Lanexa, VA (US)

(73) Assignees: BAE SYSTEMS Information and Electronic Systems Integration Inc., Nashua, NH (US); The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/154,371

(22) Filed: May 23, 2002

(51) Int. Cl.[7] ..... H02K 5/02
(52) U.S. Cl. ..... 174/51; 174/101.5; 174/78
(58) Field of Search ..... 174/51, 5 R, 5 SB, 174/5 SG, 6, 7, 78, 108, 101.5, 102 E

(56) References Cited

U.S. PATENT DOCUMENTS 3,636,409 A * 1/1972 Stephens et al. ..... 114/221 R
3,805,667 A * 4/1974 Orser ..... 174/122 R
4,017,927 A * 4/1977 Massey ..... 264/DIG. 4
4,099,281 A * 7/1978 Bowley ..... 114/294
4,885,902 A * 12/1989 Schmidt ..... 56/10.3
5,036,785 A * 8/1991 Kittredge et al. ..... 114/127
5,379,034 A * 1/1995 O'Connell ..... 114/328
5,408,221 A * 4/1995 Carsella et al. ..... 116/173
5,454,742 A * 10/1995 Robertson ..... 264/311
5,646,366 A * 7/1997 O'Connell ..... 114/21.2
6,085,628 A * 7/2000 Street et al. ..... 441/23

* cited by examiner

*Primary Examiner*—Dean A. Reichard
*Assistant Examiner*—Angel R. Estrada
(74) *Attorney, Agent, or Firm*—Daniel J. Long; Scott R. Boalick

(57) ABSTRACT

A grounding device for water vehicles. The device includes an elongated electrical conductive section. The device also includes an elongated rope for increasing water resistance positioned in an adjacent relation to the elongated electrical conductive section. The device is of particular usefulness in grounding RF transmitters on high speed water vehicles having electrically insulative hulls.

21 Claims, 3 Drawing Sheets

GROUNDING DEVICE FOR HIGH SPEED WATER VEHICLES

STATEMENT OF GOVERNMENT INTEREST

The invention described herein was made under Contract No. N66001-00-C-0018 with the Government of the United States of America and may be manufactured and used by and for the Government of the United States of America for Governmental purposes without the payment of any royalties thereon or therefor.

BACKGROUND OF THE INVENTION (1) Field of the Invention

The present invention relates to water vehicles, and more particularly to methods and apparatus for the electrical grounding of water vehicles.

(2) Brief Description of Prior Developments

Many high speed water vehicles are built with hulls comprised of nonconductive materials such as composite fiberglass and resin materials and wood. Electrical grounding of on board RF transmitters and on board electrical equipment can, therefore, require particular adaptations on the hull which may be expensive and time consuming to install. For example, in some cases a partial metal liner is installed on nonconductive hulls to facilitate grounding.

In other situations, the difficulty in grounding water vehicles with nonconductive hulls may limit communications capabilities on such vehicles. For example, many smaller high speed water vehicles with nonconductive hulls make use of VHF RF transmitters even though such transmitters are limited in terms of range. Although the extended range HF RF transmitters may be desirable for many such vessels, grounding requirements may limit the use of HF RF transmitters on such vessels.

Referring to FIG. 1, a prior art arrangement for grounding an RF transmitter is shown in which a boat 10 equipped with a transmitter 12 and an outrigger 14 is moving in a forward direction 16. The outrigger mounting 14 includes a lower horizontal beam 18 and an upper angled beam 20. There is a lower pulley 22 on the lower horizontal beam 18 and an upper pulley 24 mounted on the outer end of the upper-angle beam 20. An RF ground wire shown generally at numeral 26 extends from the RF transmitter 12. This RF ground wire 26 includes an outward length 28 which extends from the RF transmitter 12 to the upper pulley 24. From the pulley 24 to the lower pulley 22 the RF ground wire 26 includes a vertical length 30. Extending in a rearward direction 32 which is generally opposite from the forward direction of the boat 10 there is a rearward length 24 of the RF ground wire 26. At the terminal end of this rearward length 34 there is a rearward terminal weight 36 which is usually able to maintain the rearward length 34 of the RF ground wire 26 in a body of water 38 at low speeds. At higher boat speeds, however, the rearward terminal weight 36 and the rearward length 34 of the RF ground wire 26 will often begin moving in an outward and upward skipping motion 40 so that the rearward length will move out of the water as at 34' and the rearward terminal weight will similarly move to 36'.

The velocity of the water vehicle containing the RF transmitter source is "speed limited". Typically, under normal wave and weather conditions the water vehicle velocity range is only 4 to 7 knots. Under more adverse wave and weather conditions the water vehicle velocity must be reduced to maintain continuous contact with the RF ground conductor and water. The speed limitation of the water vehicle is created by a combination of the forward velocity of the water vehicle and the drag forces imposed on the weighted RF ground conductor increase causing the weighted RF ground conductor to lose continuous contact with the water. The loss of continuous contact or "skipping action" of the RF ground conductor wire causes loss of signal strength, increases interference with other electronics on the water vehicle, and can cause data collection loss during antenna calibration.

An improved method and apparatus for grounding electrical apparatus on water vehicles is, therefore, needed.

SUMMARY OF INVENTION

The present invention is a high speed RF ground device for water vehicles. The device includes an elongated electrical conductive section and an elongated rope for increasing water resistance positioned in an adjacent relation to the elongated electrical conductive section.

The present invention also encompasses a method for grounding an RF circuit on a water vehicle which includes the step of connecting an elongated grounding devise which includes an electrical conductive section and an elongated rope for increasing water resistance section to the RF circuit. The water vehicle is then caused to move in a forward direction. The elongating grounding device is then positioned to extend rearwardly from the water vehicle.

BRIEF DESCRIPTION OF THE DRAWINGS

The present invention is further described with reference to the accompanying drawings in which.

DETAILED DESCRIPTION OF THE PREFERRED EMBODIMENT

Figure 1:
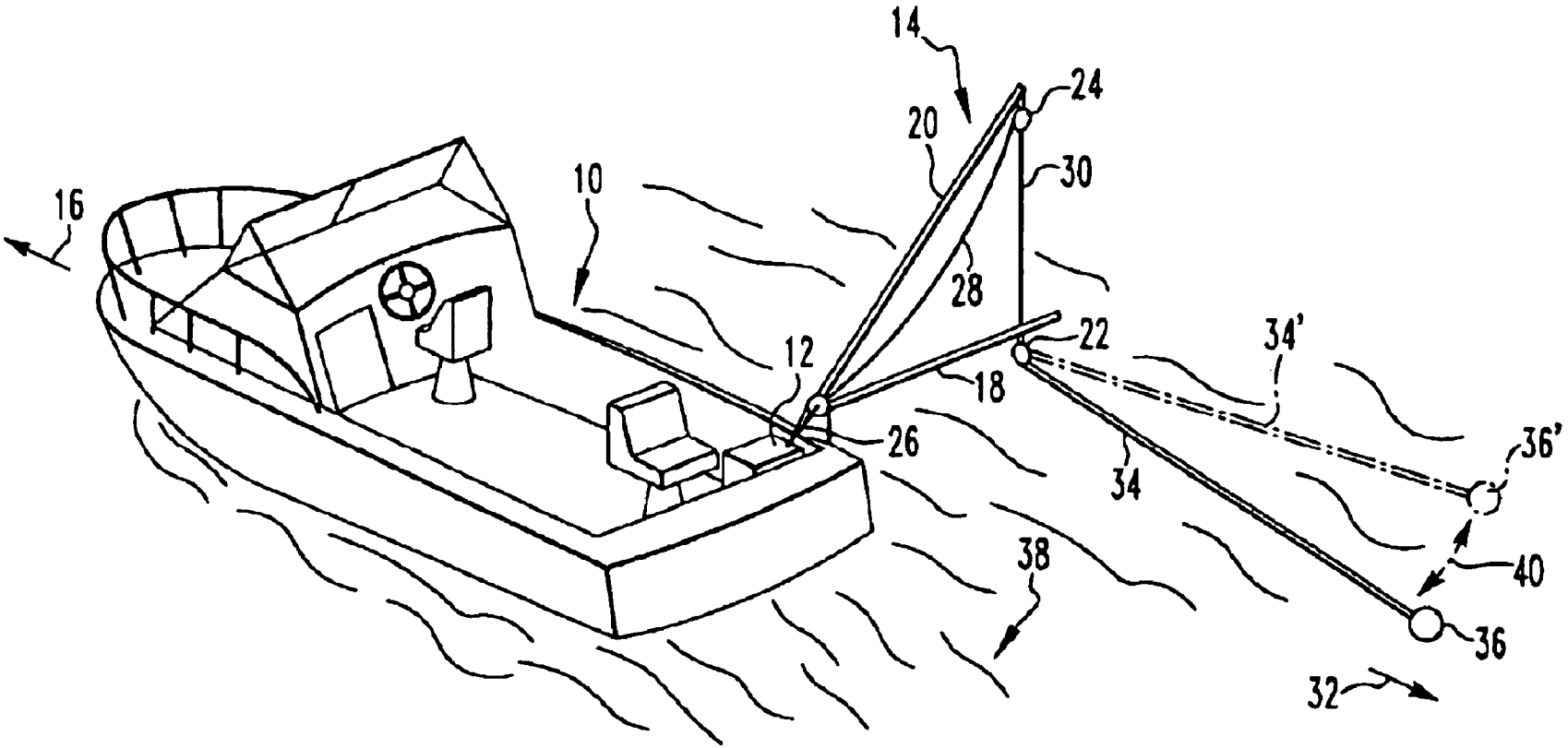
FIG. 1 PRIOR ART
FIG. 1 is a perspective view of a boat with a prior art apparatus for grounding an RF transmitter.
Figure 2:
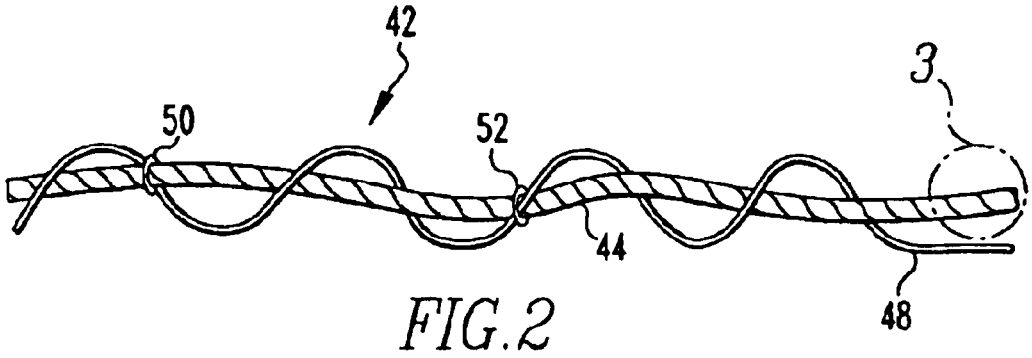
FIG. 2 is a perspective view of a preferred embodiment of the RF ground device of the present invention.
Figure 3:
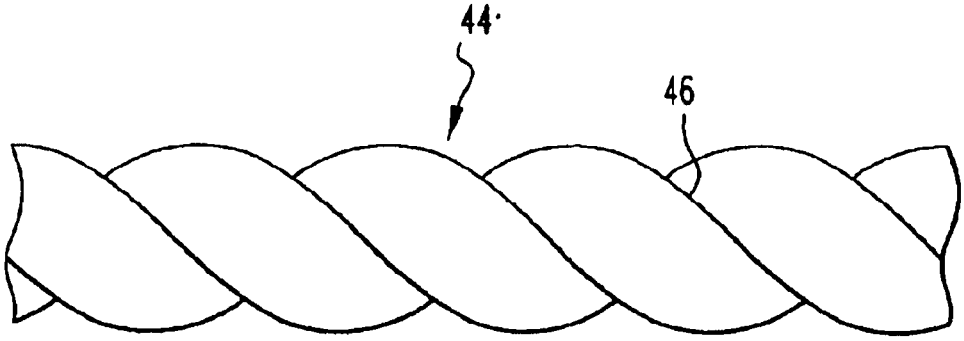
FIG. 3 is an enlarged view of the area encircled 3 in FIG. 2.

Referring to FIGS. 2 and 3, the grounding device is shown generally at 42. This grounding device includes a marine rope 44 which may be comprised of synthetic fibers, natural fibers or a mixture of natural and synthetic fibers. Referring particularly to FIG. 3, the rope 44 includes transverse spaces as at space 46 known as wicking which allows the rope to be water permeable. Referring again to FIGS. 2 and 3, the grounding device 42 also includes a conductive RF ground wire 48. There are also a plurality of insulated sleeves as at sleeves 50 and 52 which circumferentaly surround both the marine rope 44 and RF ground wire 48 and hold them together as an integral unit.

Figure 4:
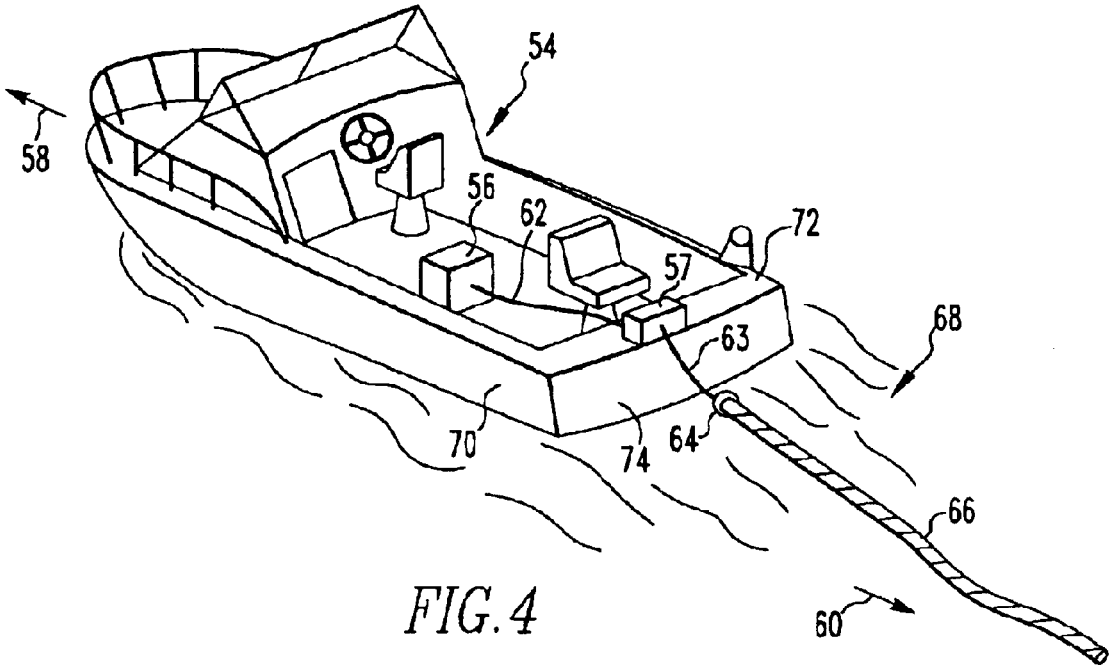
FIG. 4 is a perspective view of a boat on which the RF ground device shown in FIGS. 2 and 3 are used to ground an RF transmitter.

Referring to FIG. 4, the use of the grounding device 42 to ground an RF transmitter on a boat is illustrated. A boat 54 is equipped with an RF 56 transmitter with a tuner 57 and is in motion in a forward direction 58. In an opposed aft direction 60 an RF ground wire 62 extends from the RF transmitter 56 to the tuner 57 and another wire 63 extends from the tuner 57 through ground wire 63 to a connection 64 from where the wire rope composite device shown generally at 66 extends rearwardly into a body of water 68. Preferably the ground wire 62 extends in an aft direction approximately midway between the port side 70 and the starboard side 72 and over the stern 74 of the boat 54. In addition to mounting the device over the stern, mounting may also be through the hull and below the water line. A hydroplane device such as those used to keep fishing line submerged during trolling may also be attached at or near the aft terminal end of the rope 44. A suitable hydroplane device is commercially available from Nekton Corp. of Danville, N.H. under the trademark "Z-WING".

Water vehicles using the RF ground are not ordinarily speed limited and can traverse waypoints with as much speed as safety allows during the normal operation of this invention or under adverse wave or weather conditions. The constant RF ground plane results in a stronger more consistent signal strength, reduces interference with electronics on the water vehicle. Other advantages are the reduction in data collection storage requirements, significant reduction in time required for RF antenna calibration, and decreased water vehicle rental labor costs.

Test

The construction of the RF ground wire-rope device used during a test conducted in salt water in the Chesapeake Bay near Dam Neck, Va. was a marine synthetic type rope under water conditions of 1 to 3 foot seas. The marine synthetic rope was approximately ¾ inch in thickness and approximately 20 feet in length. The RF ground wire was wrapped along the length of the rope and secured to the rope using plastic tie-wraps forming a wire-rope. The wire-rope RF ground was jury-rigged mounted over the stern of the water vehicle and placed in the water. Water vehicle velocities of 30 knots or more were attained using this RF ground wire-rope device while maintaining constant RF signal-ground conductivity. The testing of the RF ground wire-rope device was used for beamforming calibration of an HFSWR receive antennas. The successful use of the wire-rope weighted device was attributed to the increased surface area contact of the RF wire-rope ground, flexibility of the rope material and the physical properties of water. Plastic sleeves tie-wraps were used to secure the wire and rope together which enabled the wire-rope to bend as a unit, shape itself to various wave conditions, and also allowed for the physical properties of water to be taken advantage of.

The physical properties of water (surface tension, cohesion and adhesion) allow the water (and its dissolved substances) to move through spaces (wicking) of the rope material and adhere to the solid materials used in the wire-rope device. This wire-to-water, wire-to-rope, and rope-to-water contact results in maximum continuous RF ground contact. Preferably, the characteristics of the spaces (wicking) will be selected to optimize performance for particular physical properties of the water in which use is anticipated. It will be appreciated that once the rope becomes permeated with water, particularly salt water, the overall conductivity of the device will be increased.

The mounting method described above was an expedient way to implement the RF ground wire-rope device for this test. Those of ordinary skill in the art will appreciate that various other mounting methods using downriggers, outriggers, or temporarily attached to water vehicles hull (under the water line) are acceptable within the limitations of the present invention. The only adjustment to the wire-rope construction is establishing the proper wire-rope length required for the mounting method to be used for the water vehicle. Also, the conductive RF ground wire could alternatively be on the inside of the rope or sleeve.

It will be appreciated that the RF ground of the present invention allows RF transmitters mounted on water vehicles to be efficiently and cost effectively grounded through a wide range of vehicle speeds and water and weather conditions.

It will also be appreciated that especially when used without the hydrodynamic depressor, the grounding device described above will ordinarily not become entangled with buoys or lobster or crab traps or debris in the water.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. The device for grounding water vehicles for a water vehicle having an RF transmitter comprising:

a rope;

a wire positioned continuously adjacent the rope;

a plurality of insulative sleeves circumferentially surrounding the rope and the wire to fix the rope to the wire; and a conductive means connecting the RF transmitter to the wire.

2. The device for grounding water vehicles of claim 1 wherein the rope is flexible.

3. The device for grounding water vehicles of claim 1 wherein the rope is water permeable.

4. The device for grounding water vehicles of claim 1 wherein the rope has a plurality of traverse spaces.

5. The device for grounding water vehicles of claim 1 wherein the wire helically surrounds the rope.

6. A device for grounding a water vehicle comprising:

an elongated electrical conductive section; and an elongated rope for increasing water resistance positioned in adjacent relation to said elongated electrical conductive section.

7. The device for grounding water vehicles or claim 6 wherein the rope for increasing water resistance is flexible.

8. The device for grounding water vehicles of claim 6 wherein the elongated rope for increasing water resistance is water permeable.

9. The device for grounding water vehicles of claim 6 wherein the elongated rope for increasing water resistance has a plurality of transverse spaces.

10. The device for grounding water vehicles of claim 6 wherein the elongated rope for increasing water resistance is comprised of a plurality of elongated fibers.

11. The device for grounding water vehicles of claim 10 wherein the elongated rope for increasing water resistance is comprised of synthetic fibers.

12. The device for grounding water vehicles of claim 10 wherein the elongated rope for increasing water resistance is comprised of natural fibers.

13. The device for grounding water vehicles of claim 6 wherein the elongated conductive section helically surrounds the rope for increasing water resistance.

14. The device for grounding water vehicles of claim 6 wherein a plurality of insulative sleeves bind the elongated electrically conductive section and the elongated rope for increasing water resistance.

15. The device for grounding water vehicles of claim 6 wherein the elongated electrically conductive section is a wire.

16. The device of claim 6 wherein said device grounds an RF transmitter.

17. A method for grounding an RF transmitter on a water vehicle comprising the steps of:

connecting to the RF transmitter an elongated grounding device comprising an elongated electrically conductive section and an elongated rope for increasing water resistance;

causing the water vehicle to move in a forward direction; and positioning the elongating grounding device to extend rearwardly from the water vehicle.

18. The method of claim 17 wherein the elongated means for increasing water resistance is a rope.

19. The method of claim 17 wherein the water vehicle is on a surface of a body of water and the elongated grounding device remains in substantially continuous contact with the body of water.

20. The method of claim 19 wherein the rope has transverse spaces and the water moves through said transverse spaces.

21. The method of claim 20 wherein the transverse spaces have characteristics and the water has physical properties and said characteristics of the transverse spaces are selected based on said physical properties of the water.

* * * * *